US008910790B2

(12) United States Patent
Trickett

(10) Patent No.: US 8,910,790 B2
(45) Date of Patent: Dec. 16, 2014

(54) SEPARATORS FOR UNITIZED LOADS

(71) Applicant: Howard J. Trickett, Hartville, OH (US)

(72) Inventor: Howard J. Trickett, Hartville, OH (US)

( * ) Notice: Subject to any disclaimer, the term of this patent is extended or adjusted under 35 U.S.C. 154(b) by 0 days.

(21) Appl. No.: 14/153,834

(22) Filed: Jan. 13, 2014

(65) Prior Publication Data

US 2014/0190860 A1 Jul. 10, 2014

Related U.S. Application Data

(63) Continuation of application No. 11/828,608, filed on Jul. 26, 2007, now abandoned.

(60) Provisional application No. 60/833,635, filed on Jul. 26, 2006.

(51) Int. Cl.
*B65D 85/62* (2006.01)
*B65D 71/00* (2006.01)
*B65D 5/00* (2006.01)

(52) U.S. Cl.
CPC ..... *B65D 5/005* (2013.01); *B65D 2571/00043* (2013.01); *B65D 71/0088* (2013.01)
USPC ..... 206/497; 206/83.5

(58) Field of Classification Search
USPC ..... 206/497, 479, 83.5, 386, 597
See application file for complete search history.

(56) References Cited

U.S. PATENT DOCUMENTS

| | | | | | |
|---|---|---|---|---|---|
| 3,416,652 | A * | 12/1968 | Almasy | 206/453 |
| 3,589,510 | A * | 6/1971 | Begnaud et al. | 206/497 |
| 3,776,145 | A * | 12/1973 | Anderson et al. | 108/57.16 |
| 4,852,330 | A * | 8/1989 | Carangelo | 53/399 |
| 4,877,673 | A * | 10/1989 | Eckel et al. | 428/172 |
| 5,154,297 | A * | 10/1992 | Farley | 206/599 |
| 5,267,651 | A * | 12/1993 | Hughes | 206/586 |
| 5,383,408 | A * | 1/1995 | Searcy | 108/57.16 |
| 5,845,768 | A * | 12/1998 | Simpson | 206/83.5 |
| 5,895,540 | A * | 4/1999 | David et al. | 156/226 |
| 6,247,596 | B1 * | 6/2001 | Muyskens | 206/586 |
| 6,941,877 | B2 * | 9/2005 | Dickner | 108/51.11 |

* cited by examiner

*Primary Examiner* — Steven A. Reynolds
*Assistant Examiner* — King M Chu
(74) *Attorney, Agent, or Firm* — Zollinger & Burleson Ltd.

(57) ABSTRACT

A stacked shipping configuration useful for stacked upper and lower unitized loads of soft or flexible articles such as bales of natural rubber includes an upper unitized load stacked on top of a lower unitized load. An upper separator is associated with the upper unitized load and a lower separator associated with the lower unitized load. Each separator has a first leg and a second leg with the first legs of the separators disposed against each other between the unitized loads. The separators protect the unitized loads from damage when a lifting device is inserted between the loads to lift the upper load from the lower load.

20 Claims, 4 Drawing Sheets

SEPARATORS FOR UNITIZED LOADS

CROSS REFERENCE TO RELATED APPLICATIONS

This application is a continuation application claiming priority to U.S. patent application Ser. No. 11/828,608 filed Jul. 26, 2007; which claims the benefit of U.S. Provisional Patent Application Ser. No. 60/833,635 filed Jul. 26, 2006; the disclosures of both are incorporated herein by reference.

TECHNICAL FIELD

The present invention generally relates to shipping configurations wherein a unitized load is stacked on top of another unitized load. More particularly, the invention relates to separators that are used to allow a lifting device to be inserted between stacked loads. Specifically, the invention relates to the structure of separators and the use of separators with unitized loads—especially unitized loads of soft or flexible materials such as bales of natural rubber.

BACKGROUND INFORMATION

A unitized load is a single large article or a plurality of articles grouped together for shipping. The articles may be individual items such as material bales. The article also may be containers filled with their own goods. Although the articles are usually the same, the articles may be a mixture of different things. The articles may be grouped orderly or randomly. The articles may be grouped on a wooden pallet, a non-wooden pallet, a slip sheet, a slip tray, or another shipping aid. Examples of these are described in U.S. Pat. Nos. 5,613,447, 5,881,651, and 6,490,982. Each unitized load may be stretch wrapped after it is formed. Unitized loads may be stacked one on top of the other when they are loaded into a container for shipping. When the shipper intends to stack the unitized loads, the shipper does not want to place the upper load on a thick pallet in order to save the air space that would have been occupied by the pallet. The shipper may use a thin slip sheet or a slip tray. Such unitized loads are placed directly on top of the other load. One problem with this stacking configuration is the problem of removing the top load from the bottom load after the top load settles into the top of the bottom load during transport. The loads are typically removed from the container with a power lift vehicle such as a fork lift. Inserting the forks between the upper and lower unitized loads can damage the stretch wrapping, the article packaging, or the articles themselves. When the articles are soft or flexible in nature, the process of inserting the forks between the unitized loads is more difficult and damage to at least the stretch wrap or protective packaging frequently occurs.

An example relevant to the invention is a unitized load of natural rubber bales. Each natural rubber bale is wrapped with a protective packaging layer and the entire unitized load of natural rubber bales is stretch wrapped for shipping. When one load is stacked on top of another, the natural properties of the rubber bales cause the loads to interlock together and bow outwardly. Inserting forks between these interlocked loads is not easy without damaging some portion of the load. Shippers thus desire a device and packaging configuration that solves the problem of inserting the forks between stacked upper and lower unitized loads, especially when the articles are soft or flexible.

Commercial rubber users prefer the rubber to be in bales of a convenient size, which is from about seventy to about eighty pounds, although the size of the bales varies greatly, depending on the producer and consumer. Such a size can be achieved using a bale having in the range of about 1.5 to 1.8 cubic feet of volume. The process of forming such a rectangular solid bale from the rubber is well known and will be well within the knowledge of one of skill in the rubber industry. Once formed, the bales are usually packaged in a plastic bag, although it is also known in the industry to package the bales in a shrink-wrap or stretch-wrap polymer, such as a polyethylene film. If for no other reason, this individual bale packaging minimizes the fusing of rubber in adjacent bales. Although these packaging techniques maintain the independence of the bales, the weight of the bales and the shipping time causes them to settle with the some bales to bulge outwardly. The bulging bales make the process of inserting forks of a forklift difficult.

BRIEF SUMMARY OF THE INVENTION

The invention generally provides separators and a packaging configuration wherein at least one separator is used to protect a unitized load when a fork is inserted between stacked upper and lower unitized loads. The invention also provides a configuration wherein at least two separators are used with stacked unitized loads. The separators include legs positioned against each other and between the unitized loads. The fork of the lifting device is inserted between the separator legs. The separators also indicate the proper location for the insertion of the fork so the load will be balanced once lifted.

One configuration of the separators includes a body having a first leg and a second leg. The first and second legs define a generally L-shaped structure adapted to be fit over the corner of a unitized load. The separators are aligned so that the fork may be slid between the separators when the fork is being guided between the loads. The legs between the loads may be longer than the outer legs.

In another configuration, the legs of the separator are disposed ninety degrees from one another, the longer leg is three times longer than the short leg, and the width of the short leg is the same as its length. The body of the separator is fabricated from a recyclable plastic having a thickness in the range of 0.040 inches to 0.060 inches. The longer legs are placed between the unitized loads against each other with the short legs extending away from each other.

The invention also provides a separator body that is formed flat and then bent into an L configuration for use. The L configuration may be a somewhat rounded L without a sharp angular break between the legs. In one configuration, a fold line is defined between the legs that allows the user to fold the legs into an L shape for use with the loads. The body may be formed end-to-end with another separator body. A line of separation is provided between the separator bodies.

In another configuration, the separators may define banding openings that allow for different banding configurations. Each leg may define a single banding opening, a pair of banding openings, or four banding openings. Packaging bands may be threaded through these openings to secure the separators to the unitized loads and to stabilize the loads. The separators may be used in combination with a slip sheet or slip tray to provide banding anchors.

The invention also provides a method for packaging bales of natural rubber for shipment. The method includes the steps of forming first and second unitized loads of natural rubber bales, stretch wrapping each of the loads, positioning separators at the top of the lower load and at the bottom of the upper load, and placing the upper load on top of the lower load with the separators aligned. The method may include the optional steps of securing the separators with the stretch wrap or banding the loads with packaging bands that engage the separators. The loads may be formed on a slip tray or a slip sheet.

The configurations may be implemented individually or combined together to define additional configurations of the invention.

BRIEF DESCRIPTION OF THE DRAWING FIGURES

The drawings are not to scale. Similar numbers refer to similar features throughout the specification.

DETAILED DESCRIPTION OF EXEMPLARY CONFIGURATION

Figure 1A:
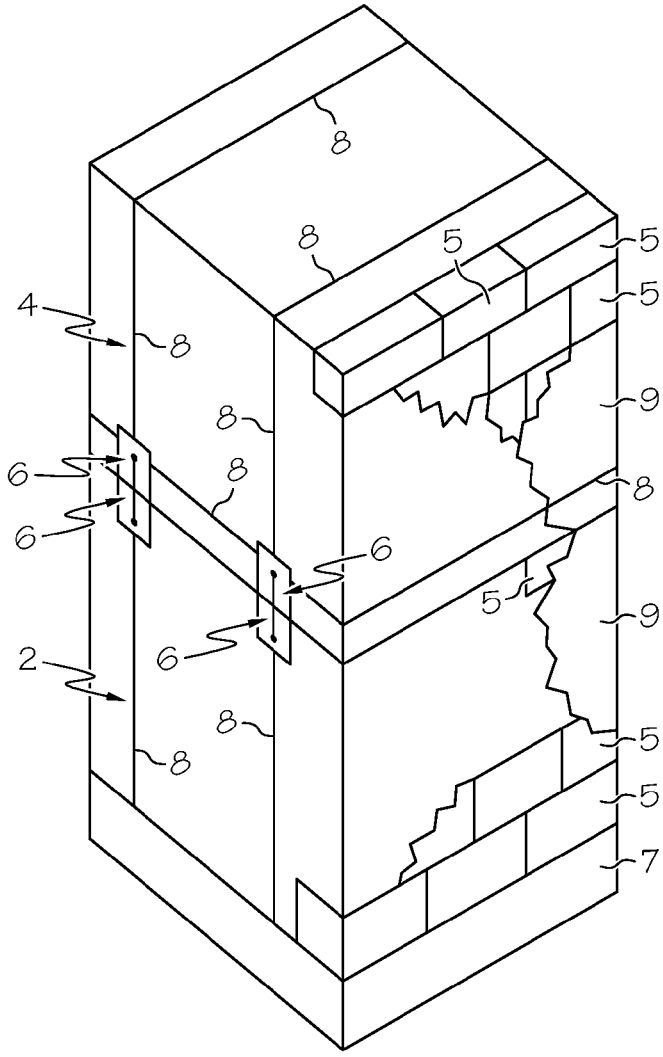
FIG. 1A is a perspective view showing stacked upper and lower unitized loads using four separators of the invention.
Figure 1B:
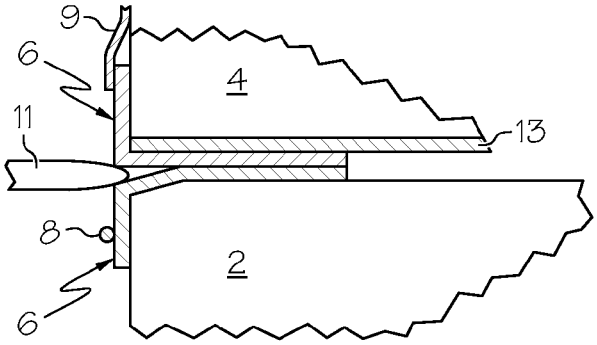
FIG. 1B is a section view showing the tip of a fork engaging a pair of back-to-back separators.

FIG. 1 depicts lower 2 and upper 4 unitized loads. Each unitized load 2 and 4 includes a plurality of stacked goods 5 that may be bales of natural rubber as described in U.S. Pat. No. 5,613,447. For example, a pallet can effectively transport between 30 and 42 of the small bales which weight about 77 pounds each. The rubber bales are, however, very sensitive to the pressure resulting from stacking. Therefore, both the height of the individual pallet and the ability to stack the pallets one upon the other are both negatively influenced by the tendency of the rubber to fuse and flow from the pressure. Those who ship loads 2 and 4 desire to stack one on top of the other as shown in FIG. 1. When stacked in this manner, upper load 4 is placed directly on top of the lower load 2. In this example, lower load 2 is carried by a slip tray 7 and upper load 2 is arranged on a slip sheet 13 shown in FIG. 1B. In other configurations, two slip trays 7 or two slip slips 13 may be used. A drawback with such stacking is experienced when trying to separate upper load 4 from lower load 2. The relatively thick forks 11 of the lift vehicle are not easily inserted between loads 2 and 4—especially after loads 2 and 4 have settled during a long journey.

Separators 6 are used to help guide the forks 11 of a lift vehicle between loads 2 and 4 while protecting goods 5. Separators 6 help forks slip between loads 2 and 4 while preventing or minimizing damage to the stretch wrapping 9 or the individual goods 5. Separators 6 are thus positioned with respect to loads 2 and 4 at locations to receive standard forks of a forklift or other lift vehicle. For example, separators 6 may be spaced 24 inches center-to-center when they are positioned on loads 2 and 4.

The body of each separator 6 may be fabricated from any of the slip sheet materials described in the patents cited above. The body may be made from a wide variety of materials including, but not limited to, plastics and metals. In the exemplary embodiment, separator 6 is formed from a recyclable polymer material such as polyethylene or high density polyethylene. The body may have a thickness from 0.010 inches to 0.100 inches with 0.040 inches to 0.060 inches being useful for many configurations. A thicker body will add rigidity and support to the bottom of loads 2 and 4 while a thinner body will flex with goods 5 while still providing the benefits of the invention described herein. A thin aluminum body may be used as an alternative.

Figure 2B:
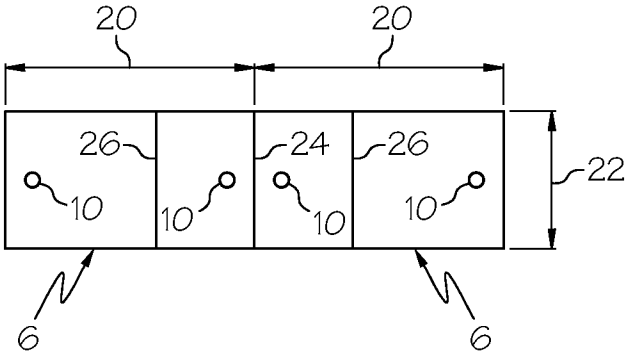
FIG. 2B is a top plan view of an alternative configuration of two separators before they are broken apart and bent around the corner of the loads.
Figure 2A:
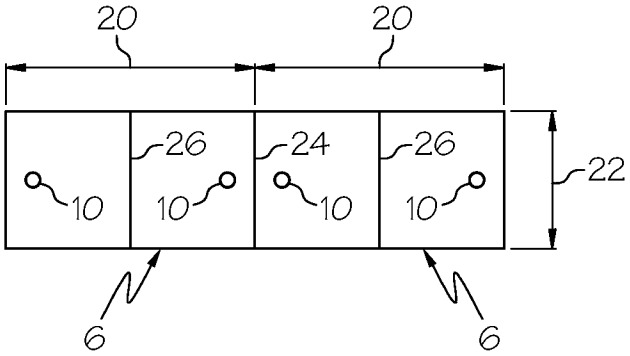
FIG. 2A is a top plan view of two separators before they are broken apart and bent to fit around the corner of the loads.
Figure 3B:
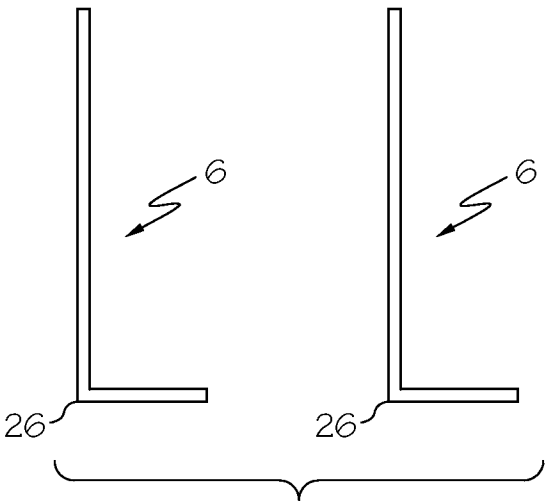
FIG. 3B is a side view of the separators from FIG. 2B after the separators are bent.
Figure 3A:
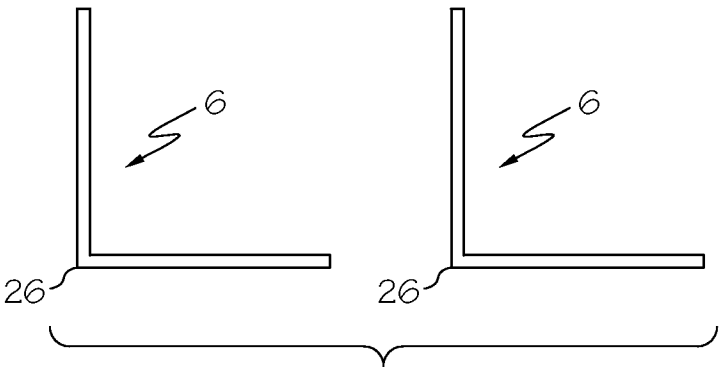
FIG. 3A is a side view of the separators from FIG. 2A after the separators are bent.

In the examples of the invention depicted in FIGS. 2A and 2B, the body of each separator has a length 20 twice as long as its width 22. In these examples, each body has a length 20 of twenty inches with a width 22 of ten inches. FIGS. 2A and 2B depict a pair of separators 6 formed end-to-end and connected by a line of separation 24 such as a score line or a perforated line (that allow the two bodies to be torn apart) or a marking line that indicates to the user where the two bodies may be cut apart. Separators 6 may be formed end-to-end in succession (such as by extrusion) and cut or torn apart as needed. Separators 6 may also be formed and sold individually. Each body may include an optional fold line 26 which may be in the form of a score line, a marking line, or a perforation. Fold line 26 may be used to fold the bodies into approximate "L" shapes for use with loads 2 and 4. The examples shown in FIGS. 3A and 3B are bent to 90 degree angles but the "L" configuration may define an angle less than 90 degrees and still provide the benefits. For example, an L having an angle of as low as 45 degrees will function in some situations. Further, the corner of the "L" may be rounded. Fold line 26 may be centered as shown in FIG. 2A to form equal legs or offset as shown in FIG. 2B in order to form a longer leg as shown in FIG. 3B. In this example, the longer leg is at least twice as long as the shorter log and may be three times longer than the shorter leg (five inch and fifteen inch). In this example, the longer leg is positioned between loads 2 and 4.

Optional banding holes 10 may be defined by the bodies of separators. In the examples, banding holes 10 are one inch diameter holes that will receive standard banding straps used in the packaging industry. Holes 10 may be centered as shown in FIGS. 2A and 2B and spaced two inches from the ends.

Figure 4:
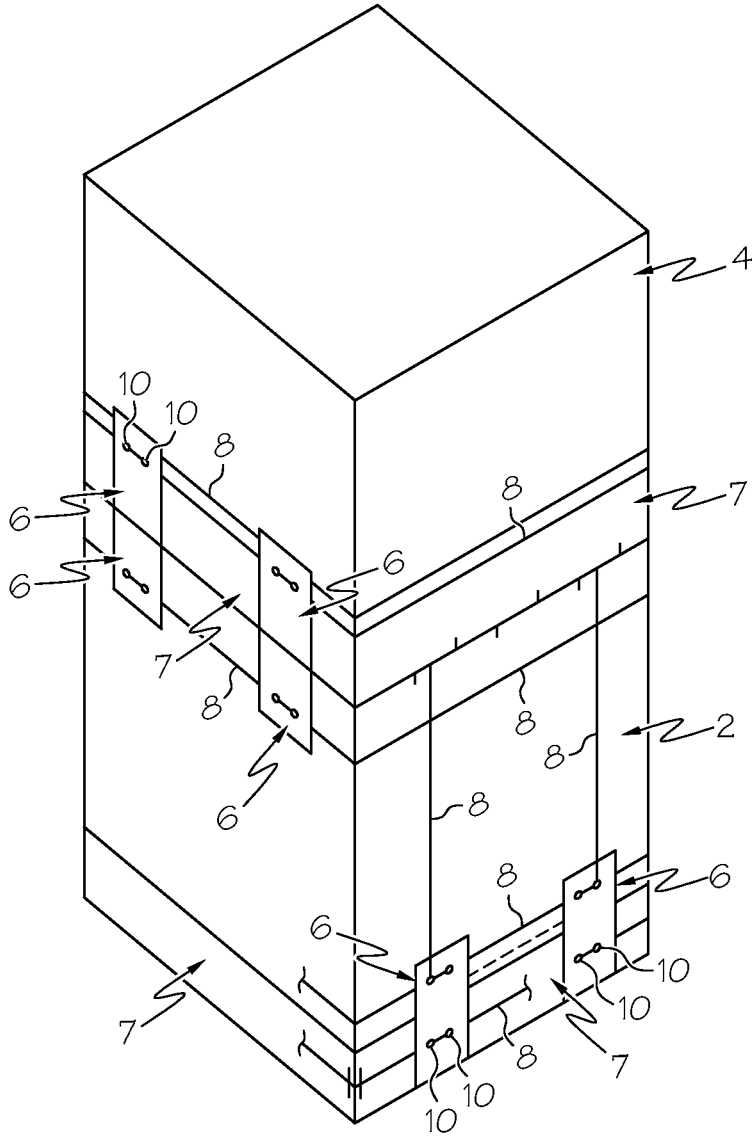
FIG. 4 is a perspective view of the stacked loads with separators showing alternative banding configurations.

When in use, each separator 6 is bent into an L configuration to fit around at least the front corners of loads 2 or 4. The front of the load is the side of the load where the forks 11 of a lift vehicle are inserted. Packaging bands 8 may be threaded through separators 6 to secure them to the load. Alternative banding configurations are shown in FIG. 1 wherein bands 8 may be vertical only, horizontal only, or a combination of both. Bands 8 may be singles (FIG. 1) or doubles (FIG. 4). If desired, additional separators 6 may be positioned about loads 2 or 4 to assist the banding. When banding is not used, separators 6 may be held in place by stretch wrap 9. Wrap 9 may be wrapped over the end of the leg of separator 6 that remains outside loads 2 and 4. Both banding and stretch wrap may be used to hold separators 6 in place.

FIG. 4 depicts an alternative configuration for separators 6 wherein pairs of banding holes 10 are defined the body of separator 6. Each leg of separator 6 may define a single pair or a double pair of banding holes 10. The double pairs are useful for double horizontal banding of the lower portion of a load 2 or 4 as shown at the bottom right hand side of load 2 in FIG. 4. The double banding may be around the sidewall of slip tray 7. These separators may have longer legs than the ten inch legs depicted in FIG. 2A. A leg length of up to twenty inches may be desirable when separators 6 are used primarily for banding.

Figure 5:
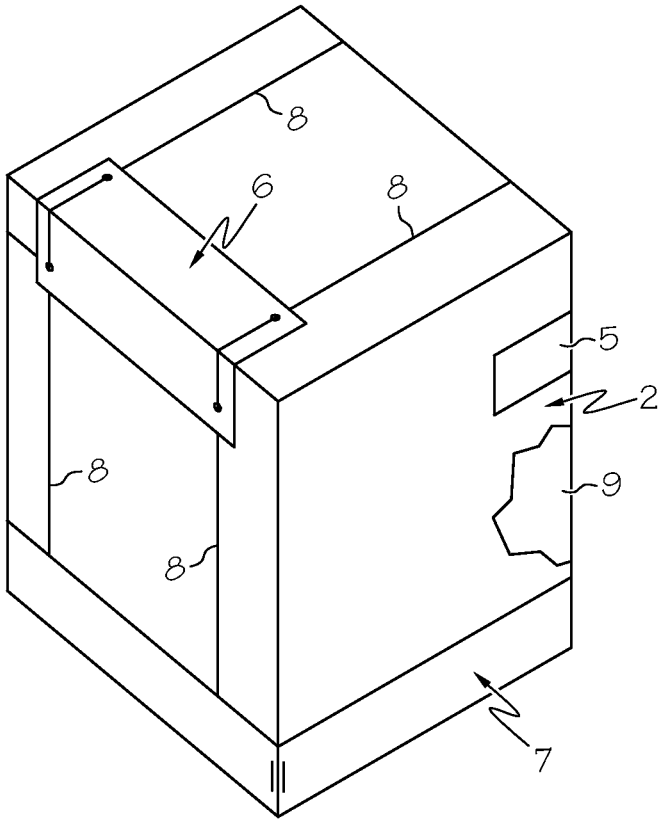
FIG. 5 is a perspective view of a lower unitized load with a single wide separator banded to its upper front corner.

Another alternative configuration of separator 6 is depicted in FIG. 5 wherein the body of separator 6 is configured to extend across most of the width of load 2. Holes 10 may be provide for optional banding.

In any of the configurations described above, upper load 4 may be packed on a slip tray 7 which may eliminate the need for separators 6 on the bottom front corner of upper load 4. In this configuration, separators are used on the upper corner of lower load 2 to work in cooperation with the bottom of slip tray 7 to protect goods 5 and wrapping 9.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A stacked shipping configuration of two unitized loads; the configuration comprising:

upper and lower unitized loads; the upper unitized load being stacked on top of the lower unitized load; each of the unitized loads having a top, a bottom, and a plurality of sides;

one of a slip sheet and slip tray disposed between at least a substantial majority of the upper and lower unitized loads and preventing a majority of the bottom of the upper unitized load from being in direct contact with the top of the lower unitized load; the one of the slip sheet and slip tray having a bottom surface;

a pair of separators disposed on the top of the lower unitized load; the separators being spaced from one another along the same side of the lower unitized load; the separators providing a forklift operator a visual guide for the proper insertion of the forks of a forklift wherein the forks are to be inserted directly between the separators and the bottom surface of the one of the slip sheet and the slip tray; and each separator having a first leg and a second leg; the first legs of the separators disposed against the bottom surface of the one of the slip sheet and slip tray between the upper and lower unitized loads; the first legs also being disposed against the top of the lower unitized load; and the second legs extending down along the side of the lower unitized load.

2. The configuration of claim 1, wherein the unitized loads are unitized bales of natural rubber.

3. The configuration of claim 1, wherein the legs of the separators are equal length.

4. The configuration of claim 3, wherein the legs are ten inches long.

5. The configuration of claim 4, wherein the legs are ten inches wide.

6. The configuration of claim 1, wherein the first leg of each separator is longer than the second leg of each separator.

7. The configuration of claim 6, wherein the first leg is at least twice as long as the second leg.

8. The configuration of claim 7, wherein the first leg is fifteen inches long and the second leg is five inches long.

9. The configuration of claim 8, wherein the first leg is ten inches wide.

10. The configuration of claim 1, wherein the separators are banded to the lower unitized load.

11. The configuration of claim 1, wherein each unitized load is stretch wrapped.

12. The configuration of claim 11, wherein the second legs are disposed under the stretch wrap.

13. The configuration of claim 1, wherein each leg defines a single banding hole.

14. The configuration of claim 1, wherein at least one leg of at least one separator defines a pair of banding holes.

15. The configuration of claim 1, wherein at least one leg of at least one separator defines four banding holes.

16. A stacked shipping configuration of two unitized loads; the configuration comprising:

upper and lower unitized loads; the upper unitized load being stacked on top of the lower unitized load; each of the unitized loads having a top, a bottom, and a plurality of sides;

one of a slip sheet and slip tray disposed between at least a substantial majority of the upper and lower unitized loads; the one of the slip sheet and slip tray having a body that defines a bottom surface;

the body extending entirely between the upper and lower unitized loads;

a pair of upper separators disposed at the bottom of the upper unitized load and a pair of lower separators disposed at the top of the lower unitized load;

the upper separators being spaced from one another along the same side of the upper unitized load;

the lower separators being spaced from one another along the same side of the lower unitized load;

the separators providing a forklift operator a visual guide for the proper insertion of the forks of a forklift wherein the forks are to be inserted directly between the upper and lower separators; and each separator having a first leg and a second leg;

the first legs of the upper separators disposed against the first legs of the lower separators between the upper and lower unitized loads;

the first legs of the upper separators disposed against the bottom surface of the body of the one of the slip sheet and slip tray; and the second legs extending along the sides of the unitized loads.

17. The configuration of claim 16, wherein the unitized loads are unitized bales of natural rubber.

18. The configuration of claim 16, wherein the first leg of each separator is longer than the second leg of each separator.

19. The configuration of claim 18, wherein the first leg is at least twice as long as the second leg.

20. The configuration of claim 16, wherein each separator defines at least one banding hole.

* * * * *